US006371773B1

(12) United States Patent
Crofoot et al.

(10) Patent No.: US 6,371,773 B1
(45) Date of Patent: Apr. 16, 2002

(54) HIGH DENSITY INTERCONNECT SYSTEM AND METHOD

(75) Inventors: Larry M. Crofoot, Perry; John T. Venaleck, Painesville, both of OH (US)

(73) Assignee: Ohio Associated Enterprises, Inc., Painesville, OH (US)

( * ) Notice: Subject to any disclaimer, the term of this patent is extended or adjusted under 35 U.S.C. 154(b) by 0 days.

(21) Appl. No.: 09/815,570

(22) Filed: Mar. 23, 2001

Related U.S. Application Data

(60) Provisional application No. 60/191,519, filed on Mar. 23, 2000.

(51) Int. Cl.[7] ..... H01R 12/00
(52) U.S. Cl. ..... 439/79; 439/608
(58) Field of Search ..... 439/79, 78, 80, 439/108, 701, 608, 607

(56) References Cited

U.S. PATENT DOCUMENTS

| | | | | | |
|---|---|---|---|---|---|
| 5,104,341 | A | * | 4/1992 | Gilissen et al. | 439/608 |
| 5,620,340 | A | * | 4/1997 | Andrews | 439/608 |
| 5,775,947 | A | * | 7/1998 | Suzuki et al. | 439/608 |
| 6,146,202 | A | * | 11/2000 | Ramey et al. | 439/608 |

* cited by examiner

*Primary Examiner*—Tulsidas Patel
(74) *Attorney, Agent, or Firm*—Renner, Otto, Boisselle & Sklar, LLP

(57) ABSTRACT

An electrical interconnect system allows high signal density with means of electrical isolation to minimize degradation of electrical signals. The electrical interconnect system includes signal conductors which are surrounded by multiple reference or ground conductors, a given signal conductor for example surrounded by four reference conductors. The interconnect system includes a reference element with two sets of reference conductors, one of the sets offset a distance from the other set.

37 Claims, 12 Drawing Sheets

HIGH DENSITY INTERCONNECT SYSTEM AND METHOD

This application claims priority from U.S. Provisional Application No. 60/191,519, filed Mar. 23, 2000, which is herein incorporated by reference in its entirety.

FIELD OF THE INVENTION

The present invention relates to electrical connectors and interconnect devices and to methods therefor and, more particularly, to maintenance of signal isolation and integrity and obtaining high signal density in connectors and connector systems used in association with printed circuit boards, circuit cards, back panels and other like substrates.

BACKGROUND OF THE INVENTION

Advancing technology has allowed the development of high density electronic circuits and components located on printed wiring boards and printed circuit boards. This miniaturization of electronic circuits and components has created a need for electrical connectors to interconnect electrically and mechanically one printed circuit board, such as a back panel or mother board, to one or more other printed circuit boards, such as daughter boards. To retain the benefits of this miniaturization, it is desirable for the connectors to have high signal densities. For example, it is desirable for there to be a large number of signals per unit space, such as surface area or volume of the connectors. However, high signal density in a connector can lead to electrical interference and cross-talk, where the signal in one signal conductor of a connector causes degradation in the signal of an adjacent signal conductor. Accordingly, there is a need to reduce such interference, cross-talk and similar signal degradation, and especially to do so in relatively small size connectors while providing relatively high signal density.

In addition, technological advances have led to higher switching speeds in printed circuit boards. As switching speeds increase, signal integrity becomes all the more important. Signal propagation speed also takes on increased importance as switching speeds increase. Higher signal propagation speeds and miniaturization also tend to increase signal reflections along conductive paths, and this is another source of signal degradation. Accordingly, there is a need to provide for relatively high signal propagation speeds with relatively low reflection.

Shields and ground conductors have been used in the past to reduce cross-talk and other signal degradation in electrical connectors and in cables. The ground conductors and/or shields were coupled to actual ground reference potential or to some other reference potential (hereinafter the term "ground" also means a source of reference potential, whether an actual ground or some other potential) and they were held in place in relation to the signal conductors by the connector housing, for example, resulting in a relatively large and complex device that is relatively difficult and/or costly to manufacture. Accordingly, there is a need to minimize the complexity of connectors and to facilitate manufacturing, and, accordingly, to minimize cost of connectors.

From the foregoing, it can be seen that there is a need for electrical connectors that minimize electrical interference or cross talk and maximize signal density, while maintaining manufacturability.

SUMMARY OF THE INVENTION

Briefly, the present invention concerns an electrical connector system (sometimes referred to as an interconnect system) that allows high signal density with means of electrical isolation to minimize degradation of electrical signals.

According to an aspect of the invention, an electrical interconnect system includes two connector portions, each for connection to a respective circuit board or the like and for interconnection with each other thereby to interconnect the circuit boards or the like.

According to another aspect of the invention, an electrical interconnect system includes signal conductors which are surrounded by multiple reference or ground conductors. In an embodiment of the invention, a given signal conductor may be surrounded by four reference conductors.

According to still another aspect of the invention, an interconnect system includes a reference element with two sets of reference conductors, one of the sets offset a distance from the other set.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Figure 2:
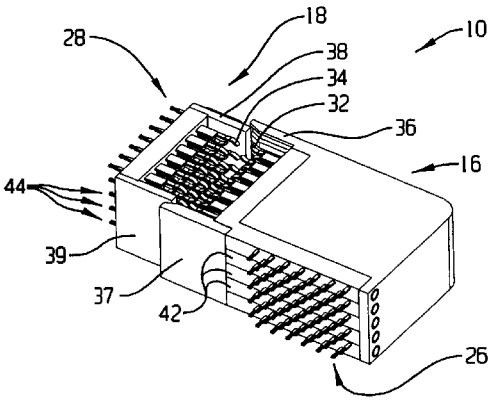
FIGS. 1–4 are various views of an interconnection system according to the present invention.

A high density electrical interconnect system includes signal conductors interspersed with ground or reference conductors. Multiple ground or reference conductors are placed around each of the signal conductors. For example, a signal conductor may have four ground or reference conductors surrounding it, a ground or reference conductor running parallel to the signal conductor in each of four directions. Two of the reference conductors may be in directions perpendicular to the directions of the other two reference conductors. Thus a signal conductor may have ground or reference conductors running parallel to it along its top and bottom, and running parallel to it on opposite sides of it.

Modular elements may be used to form the portions of the interconnect system. A modular element may include a signal conductor element and a ground or reference element. The signal conductor element has planar, generally-parallel signal conductors. The ground or reference element has two sets of ground or reference conductors, one set in the plane of the signal conductors and between adjacent of the signal conductors, the other set being offset from the plane of the signal conductors and running parallel to respective of the signal conductors, for example being directly above or below respective of the conductors. The first set of ground or reference conductors, those in the plane of the signal conductors, may be bent so as to achieve an offset from the second set of ground or reference conductors.

The ground or reference conductors provide electrical isolation to the signal conductors, reducing cross-talk and other interference from other of the signal conductors. In addition, the signal conductors are for the most part surrounded by air, as opposed to a dielectric material such as plastic.

Referring to the drawings and initially to FIGS. 1–5, an interconnect system 10 is shown which connects plural circuit boards or the like, such as a daughter board 12 to a mother board 14. In the illustrated embodiments such combination of boards is at a right angle, but it will be appreciated that such connections may be at other angles. The system 10 includes a daughter board connector portion 16 and a mother board connector portion 18. The connector portions 16 and 18 are intended for connection to the respective boards 12 and 14 via respective arrays of holes 22 and 24 in the boards. The connector portions have respective sets of pins 26 and 28 which mate with the arrays of holes 22 and 24.

The connector portions 16 and 18 are capable or being mechanically and electrically coupled together. Daughter board portion contacts 32 mate with corresponding mother board portion contacts 34 (both also sometimes referred to as "contact ends" or "terminals"). The mating of the contacts 32 with the contacts 34 provides electrical connection between the conductors of the daughter board portion 16 and corresponding conductors of the mother board portion 18. In addition the portions 16 and 18 have respective sets of guides 36–37 and 38–39 to facilitate proper alignment of the portions as they coupled together.

An overview of the system 10 is given initially, with a more detailed description of the parts thereof following. Briefly, each of the connector portions 16 and 18 includes plural respective connector modules 42 and 44 and retained in positional relation by relatively small carrier rails. The carrier rails of the daughter board portion modules 16 mate with corresponding slots in a cover 46 and with one of the daughter board guides 36 and 37. The carrier rails of the mother board portion modules 44 mate with corresponding slots in the mother board guides 38 and 39.

Each connector module includes plural signal and ground conductors, the signal and ground conductors interspersed as described above. The conductors are arranged such that adjacent to each signal conductor or in close proximity to each signal conductor are multiple of the ground conductors. Minimizing space, area, interconnections, etc. between the ground conductors and the circuit board to which they are to be connected, a plurality of the ground conductors are connected together, for example all or substantially all of the ground conductors of a single module being connected together. Therefore only some of the ground conductors need be connected to electrical circuits on the circuit board, rather than directly and individually connecting every such ground conductor to circuits on the board. It will be appreciated that coupling the ground connectors together may also be advantageous from the standpoint of reducing crosstalk or other undesirable electrical effects.

Figure 1:
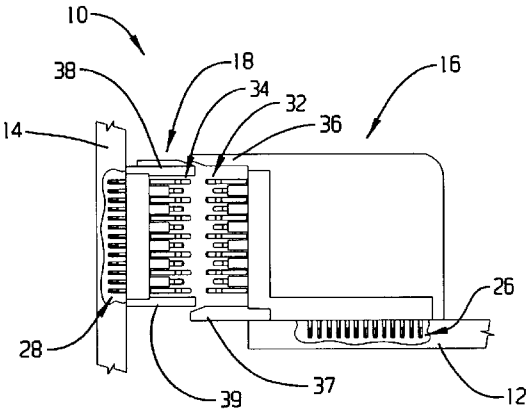
Figure 4:
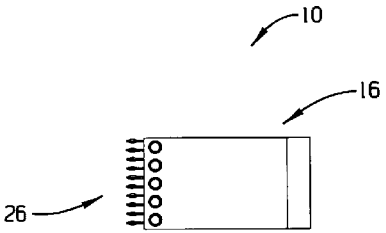
Figure 5:
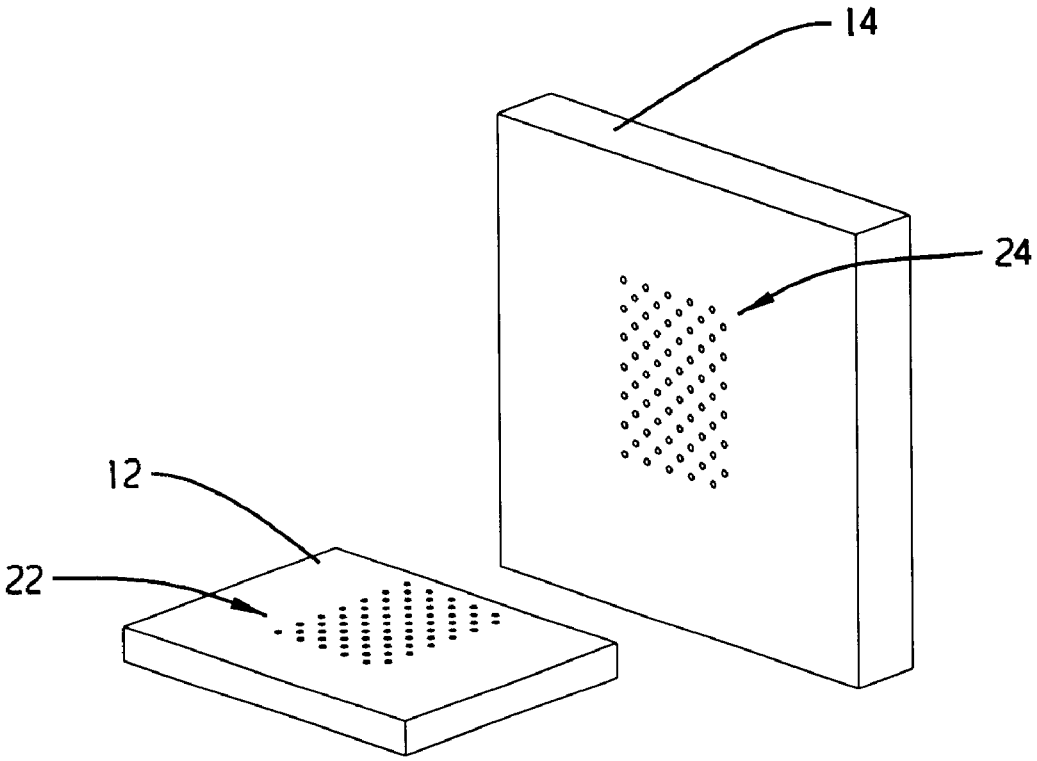
FIG. 5 is a perspective view of a mother board and a daughter board having holes for receiving respective mother and daughter board portions of the interconnect system of FIGS. 1–4.
Figure 6:
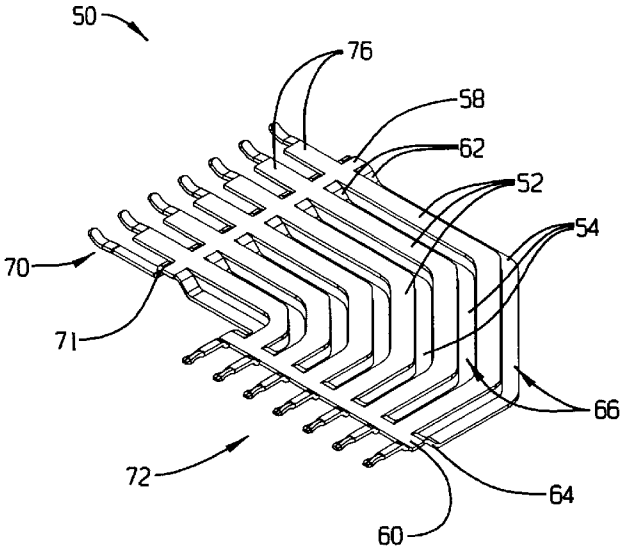
FIGS. 6–9 are various views of a reference element of the interconnect system of FIGS. 1–4.
Figure 9:
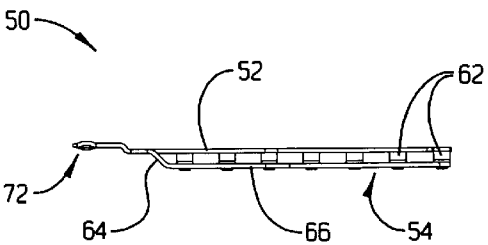
Figure 7:
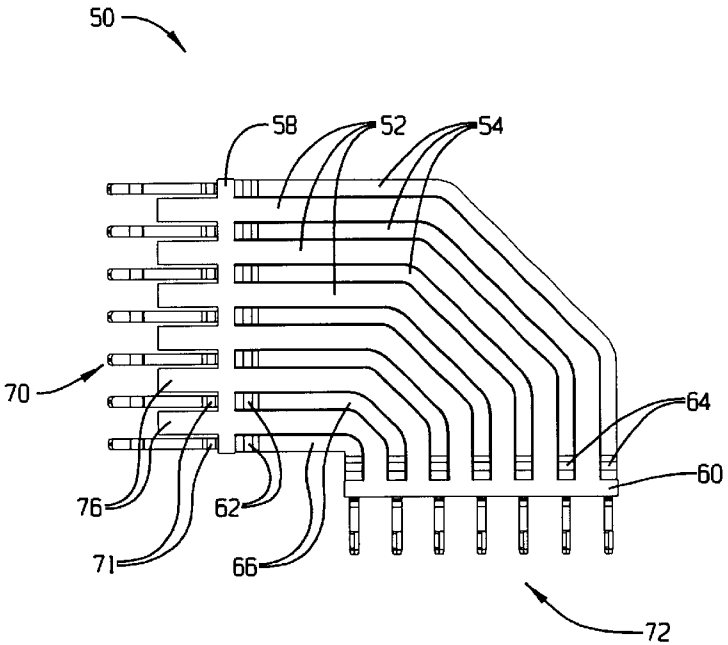
Figure 8:
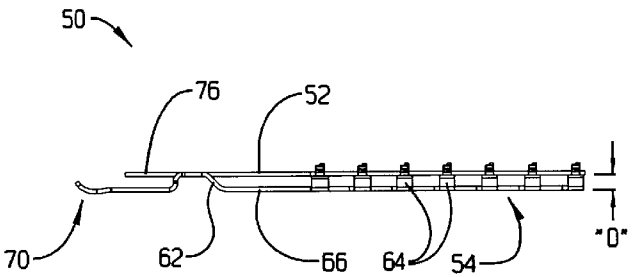
Figure 10:
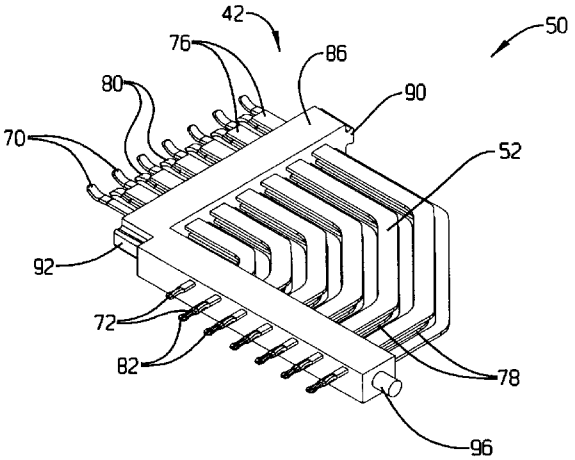
FIGS. 10–13 are various views of a daughter board portion module of the interconnect system of FIGS. 1–4 which includes the reference element of FIGS. 6–9.
Figure 13:
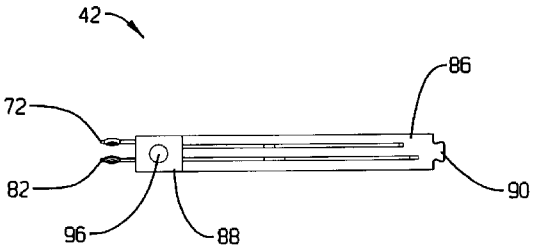
Figure 11:
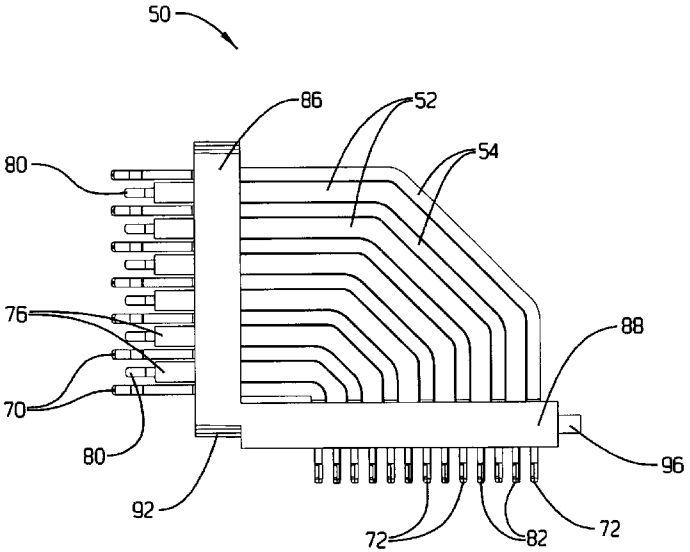
Figure 12:
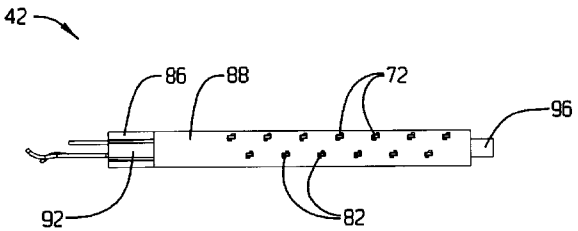

As is shown in FIGS. 1 and 5, the mother board 14 may be sufficiently thick so that the holes 24 in the mother board 14 are sufficiently long to receive two mother board *connector portions 18 therein, one on each side of the mother board 14, in a mid-plane connection scheme. The mother board connector portions 18 in such a scheme may be connected with respective daughter board connector portions 16 of respective daughter boards 12, in a manner similar to that shown in FIG. 1. Having the mother board 14 be able to accept two mother board connector portions 18, e.g., respectively, via the back plane and front plane of the mother board, in each of the sets of holes 24, effectively may double the density of connections on and/or to the mother board 14.

The connector modules 42 may be identical with one another. The connector modules 44 also may be identical with one another, although respective connector modules may have differences, if desired. Use of identical connector modules reduces the number of types of parts needed for manufacture, thereby reducing costs and facilitating manufacturing.

To minimize space required for the interconnect system and for desirable impedance matching and signal propagation speed characteristics, there may be a minimal amount of housing material for the interconnect system. In many prior electrical connectors the conductors thereof were contained in and/or were embedded, enclosed, encased or molded into, a housing containing a substantial amount of plastic or plastic-like material. However, such housing material has a relatively low dielectric constant (especially compared to that of air), which may increase the likelihood of signal reflection, slow signal transmission, or result in some undesirable cross-talk or the like. In contrast, in the present invention there may be a reduced amount of such housing material. Rather, there is substantially open space between respective conductors and thus there is substantial use of air, which has a relatively high dielectric constant, e.g., of one (1), as the dielectric. Use of an air dielectric improves the impedance characteristics and signal transmission characteristics, e.g., propagation speed and reduced likelihood of reflection, of the invention. Minimizing use of plastic or plastic-like materials may save material and manufacturing costs, as well as space.

With the connector portions 16 and 18 mounted or attached to respective daughter and mother boards 12 and 14, the daughter board connector portion 16 is adapted to mate with or otherwise engage the mother board connector portion 18 to provide electrical connection between the daughter board 12 and the mother board 14, via mating of the contact ends 32 and 34 (sometimes referred to as terminals). The assembled connector portions 16 and 18 are held together in part by the mechanical forces due to the bending of the contact ends 32 and 34 as the connector portions 16 and 18 are coupled.

Turning now to FIGS. 6–9, various views are shown of a ground or reference element 50 of one of the daughter board portion modules 42. The reference element includes two sets of reference conductors: a first set of flat reference conductors 52, and a second set of bent or offset reference conductors 54. The reference conductors 52 and 54 are joined together by metal strips 58 and 60 at respective ends of the reference element 50, thereby commoning the reference conductors at the ends. It will be appreciated that the fields induced by reflected signals in the reference conductors 52 and 54 may be greatly reduced by commoning the reference conductors Adjacent the strips 58 and 60, the bent conductors 54 have respective bent portions 62 and 64 so that a central portion 66 of each of the bent conductors is offset a distance D from the flat reference conductors 52. As will be described in greater detail below, the central portions 66 of the bent conductors 54 will be interspersed between and around signal conductors of the daughter board portion module 42.

The reference element 50 has reference element contact ends 70 protruding from the strip 58 at locations corresponding to respective of the bent reference conductors 54. Bent portions 71 may be used to locate the reference element contact ends 70 with the same offset D as the central portions 66. As mentioned above, the contact ends 70 are designed for hermaphrodite mating with corresponding contact ends. This hermaphrodite mating is described in greater detail below.

Reference element pins 72 are attached to the strip 60 at locations corresponding to respective of the bent reference conductors 54. The pins 72 may be offset from both the flat reference conductors 52 and the bent reference conductors 54. The pins 72, as well as the other pins of the portions 16 and 18, may be press-fit pins of a type described in greater detail below.

The flat reference conductors 52 have extensions 76 which extend beyond the strip 58 and provide shielding and/or signal isolation in the region where the contact ends of the portions 16 and 18 are coupled.

The flat reference conductors 52 may have a different width than the bent reference conductors 54. For example, as shown, the flat reference conductors 52 may have be wider than the bent reference conductors 54. The combined width of the reference conductors 52 and 54 may be substantially the same as the width of a piece of material from which the reference element 50 may be formed. That is, the reference element may be formed from a piece of sheet material, for example by stamping, with substantially all of the material in the area of the reference conductors 52 and 54 being retained.

The reference element 50 may be made of a suitable electrically-conductive material, for example a suitable metal having high electrical conductivity.

The reference conductors 52 and 54 may each have a rectangular cross section, for example having a width at least several times as great as a thickness.

It will be appreciated that alternatively the configuration of the reference element 50 may be varied from that shown. For example, the contact ends 70 and/or the pins 72 may have a different offset distance. As another example, the contact ends 70 and/or the pins 72 may be located other than at locations corresponding to that of the reference conductors 54. It will be appreciated that a greater or lesser number of pins 72 may be employed. The offset between the two sets of reference conductors may be varied, and may be accomplished other than by bending.

Figure 14:
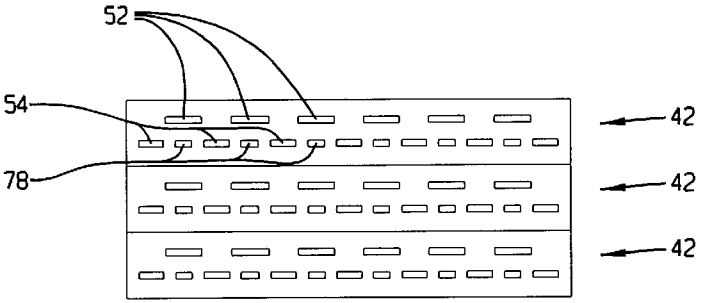
FIG. 14 is a schematic diagram illustrating the geometry of the conductors of several daughter board portion modules, looking generally along section 14—14 of FIG. 11.

Turning now to FIGS. 10–13, details of the daughter board portion module 42 are shown. The module 42 includes a plurality of co-planar, substantially-parallel signal conductors 78, as well as the reference element 50 described above. As best illustrated in FIG. 14, the signal conductors 78 are situated relative to the reference element 50 such that each of the signal conductors is between a pair of the bent reference conductors 54, and is directly underneath (as illustrated) one of the flat reference conductors 52. This arrangement provides for electrical isolation of the signal conductors 78 without undue physical separation of (e.g., large space between) them. The conductors 78 are preferably substantially parallel to each other in order to achieve high density of the signal conductors with the just-described electrical isolation.

The signal conductors 78 each have a signal conductor contact end 80 at one end and a signal conductor pin 82 at an opposite end. The signal conductor contact ends 80 may be similar to the reference element contact ends 70, and the signal conductor pins 82 may be similar to the reference element pins 72. The signal conductor contact ends 80 are substantially co-planar with the reference element contact ends 70, and the signal conductor pins 82 are offset relative to the reference element pins 72, although it will be appreciated that other configurations are possible.

The signal conductors 78 may be made of a suitable electrically-conducting material, such as a suitable metal. The conductors themselves may have a rectangular cross-section, with a width greater than their thickness. Employing signal and reference conductors with a width several times greater than thickness may reduce space requirements for the connector modules, allowing the modules also to be somewhat planar or two-dimensional, facilitating loading and/or stacking of the modules in the cover 46.

Figure 3:
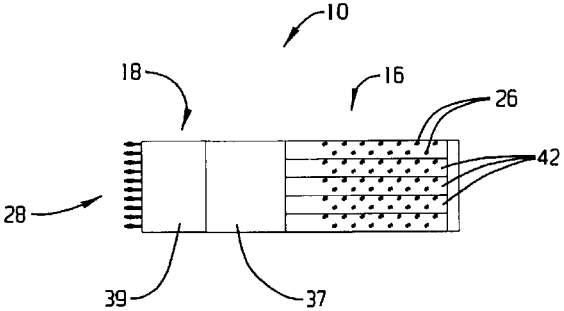

The reference element 50 and the signal conductors 78 are held in place relative to one another by retainer strips 86 and 88. The retainer strips 86 and 88 may be made of plastic and may be formed as a single unit by overmolding them onto the reference element 50 and the signal conductors 78 as the reference element and the signal conductors are held in place. The retainer strip 86 has dovetail shape tab-like members or surfaces 90 and 92 designed to facilitate loading into and/or retaining the module 42 in the cover 46 and/or the daughter board portion guide 37 (FIGS. 1–3). A protrusion 96 on the retainer strip 88 fits into one of a series of below-described holes in the cover 46, to thereby facilitate alignment of the module 42 relative to the cover, and/or to aid in retaining the module relative to the cover.

As shown, the conductors 78 do not have the ninety-degree corners or sharp bends which occur in conductors of other prior arrays of conductors. Such corners and sharp bends may cause a partial reflection of a high frequency signal that passes along the conductors—these reflections degrade the quality of the signal. The conductors 78 have two bends each, with each of the bends greater than ninety degrees, i.e., the angles are obtuse. This relatively gradual bending reduces degradation of signal quality due to reflections.

Air is preferably used as the dielectric for most of the travel of the signal conductors 78 (except where the signal connectors pass through the retainer strips 86 and 88). Air is advantageous as a dielectric because air has a relatively high dielectric constant of one (1), compared to that of typical plastic materials, which often are used to manufacture electrical connectors. The air dielectric results in a very small propagation delay, and therefore permits higher signal propagation speeds than would be the case for plastic encased conductors.

Referring to FIG. 14, a schematic layout is shown of the signal conductors 78 and the reference conductors 52 and 54 of a stack of daughter board portion modules 42. The multiple reference conductors 52 and 54 create a lattice array of separate reference conductors around individual or the intervening signal conductors 78. This lattice array of reference conductors provides electrical isolation of the signal conductors and reduces crosstalk. The spacing between the reference conductors 52 and 54 which surround an individual signal conductor 78 may be small enough to substantially fully isolate the signal conductor from the most common and/or most detrimental forms of interference and/or signal degradation.

The geometries of the conductors 52, 54, and 78 determine the inductance and capacitance of the conductors. The inductance and capacitance in combination determine the impedance of the respective conductors. It will be appreciated that the impedance of some or all of the conductors may be adjusted by adjusting the cross-section geometry and/or the spacing of the conductors 52, 54, and 78.

The signal conductors 78 may all have the same width, which may be the same as the width of the bent reference conductors 54. However, it may be desirable for the width of the bent reference conductors 54 to be different from the width of the signal conductors 78. In addition, it may be desirable for the widths of the individual of the bent reference conductors 54 and/or the signal conductors 78 to be different. It also may be desirable to have different geometries of conductors along the length thereof.

It will be appreciated that the "flat" reference conductors 54 may alternatively have a cross-sectional shape that is curved or otherwise not flat, if so desired.

It is advantageous for the impedance of the signal conductors 78 to be relatively constant as signals propagate therethrough, thereby avoiding another potential source of signal reflections which can cause degradation of signal quality. Therefore it may be desirable to change the dimensions of the signal conductors 78 as they move from a region where they are surrounded by air to where they are enclosed by or immersed in the plastic retainer strips 86 and 88. This is because the plastic dielectric may cause a signal in the conductor contained in the plastic or other dielectric to slow down relative to transmission in a portion of the conductor in an air dielectric. The impedance change caused by the change in dielectric material may be overcome by a change in conductor geometry in order to avoid partial reflections of the signals. Thus the conductors 78 may have a wider portion as they pass through the plastic retainer strips 86 and 88.

Figure 16:
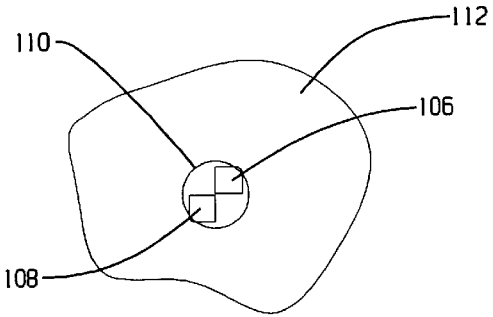
FIG. 16 is an illustration showing insertion of the pin FIG. 15 in a hole on a board.
Figure 15:
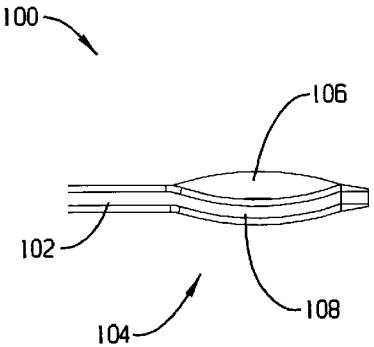
FIG. 15 is a side view showing a press-fit pin used into the interconnect of FIG. 1.
Figure 18:
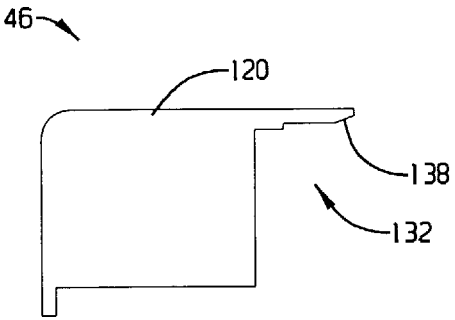
FIGS. 17–20 are various views showing a daughter board portion cover used in the interconnect system of FIG. 1.
Figure 20:
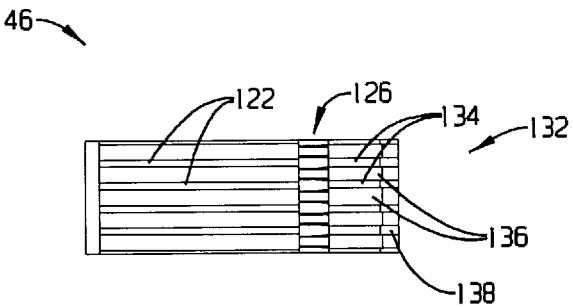
Figure 17:
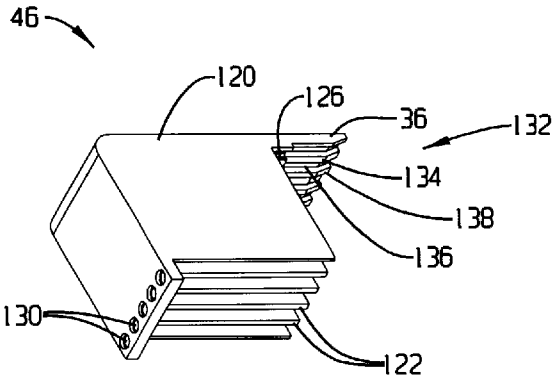
Figure 19:
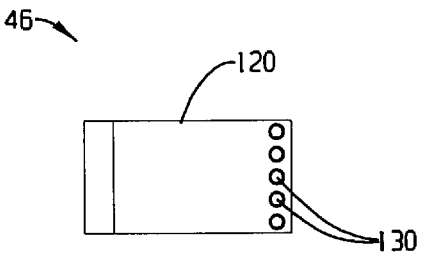
Figure 21:
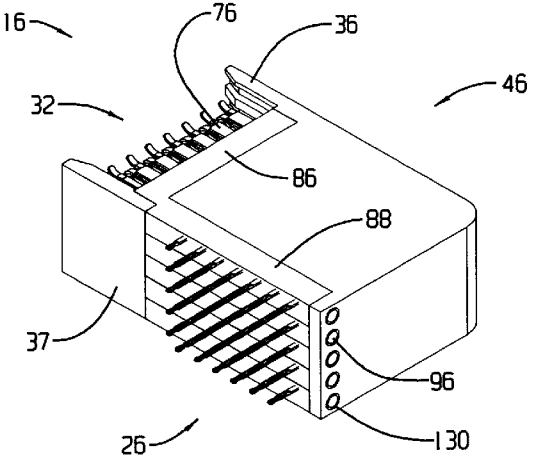
FIGS. 21–24 are various views showing a daughter board portion of in the interconnect system of FIG. 1.
Figure 22:
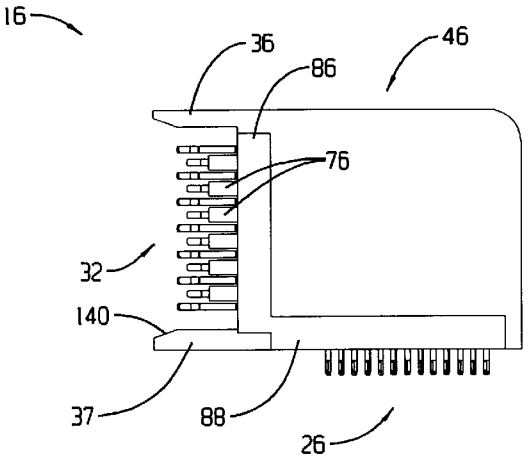
Figure 24:
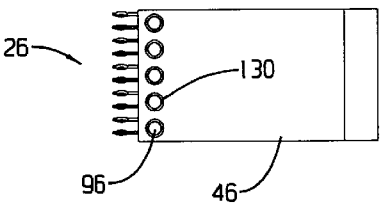
Figure 23:
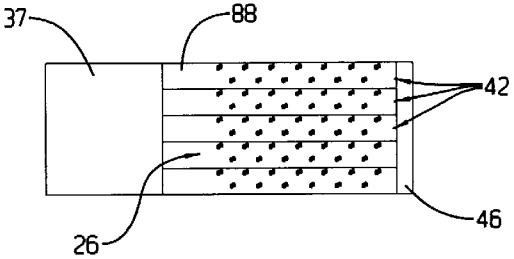
Figure 25:
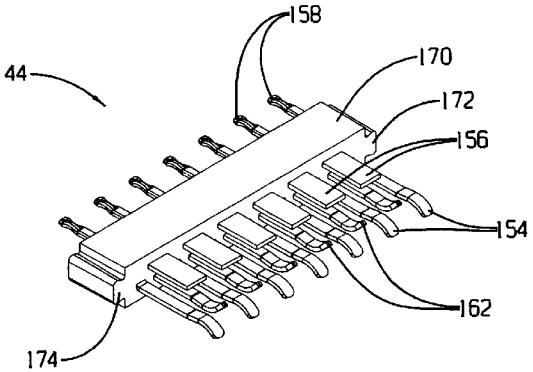
FIGS. 25–28 are various views of a mother board portion module of the interconnect system of FIGS. 1–4.
Figure 28:
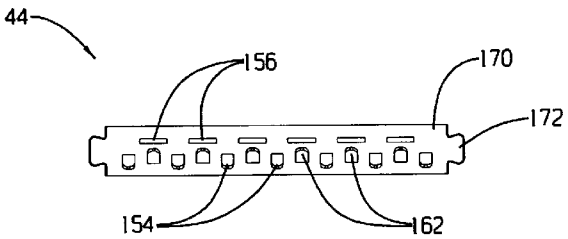
Figure 26:
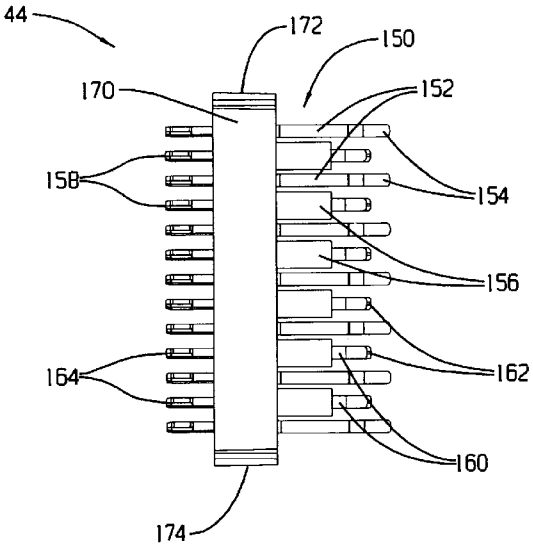
Figure 27:
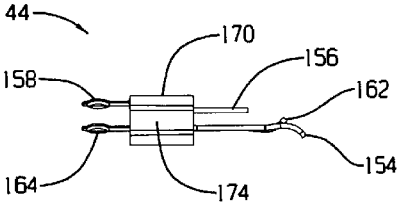
Figure 29:
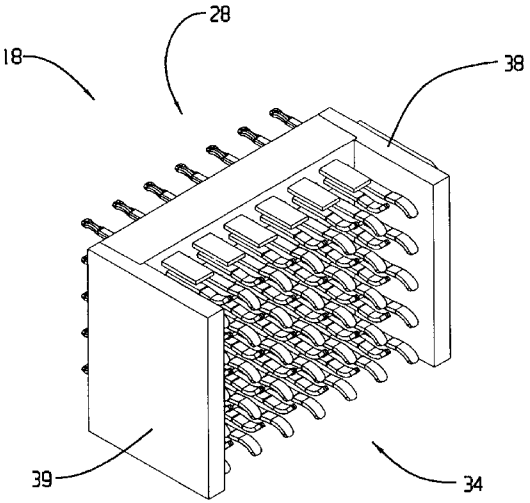
FIGS. 29–32 are various views showing a daughter board portion of in the interconnect system of FIG. 1.
Figure 32:
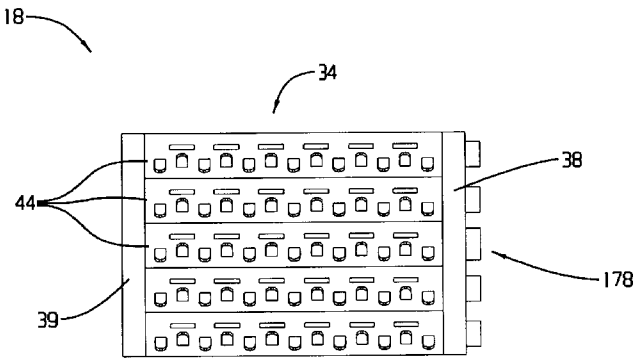
Figure 30:
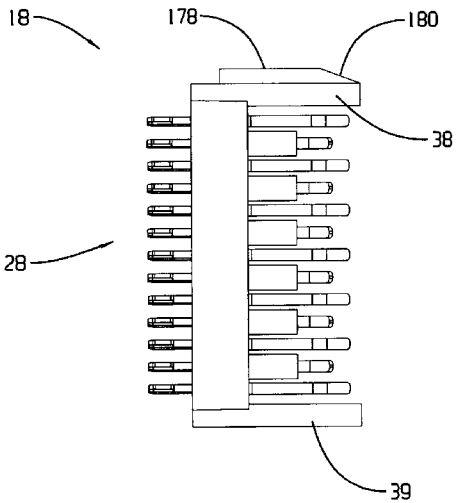
Figure 31:
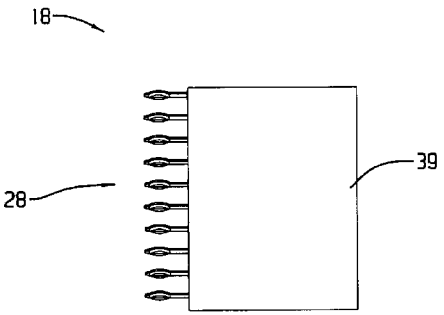

The pins 26 and 28 may be press-fit pins of the type shown in FIGS. 15 and 16. An exemplary press-fit pin 100 includes a flat section 102 which has a cut segment 104, which divides the section 102 into two resilient (or compliant) parts 106 and 108 The parts 106 and 108 are bent in opposite directions, thereby making the cut segment 104 larger than the diameter of a hole 110 in a board 112 into which the pin 100 is to be inserted, as shown in FIG. 16 As the pin 100 is inserted with force into the hole 110, the parts 106 and 108 straighten sufficiently by engagement with the wall bounding the hole 110 to allow the cut segment 104 to enter the hole. The pin 100 is retained in the hole 110 by the force of the resilient parts 106 and 108 against the walls of the hole 110.

Alternatively, it will be appreciated that other board contact ends may be employed in place of press-fit pins. For instance, straight pins may be used, the straight pins being secured in holes by being soldered into place.

FIGS. 17–20 show details of the cover 46, which may be made of plastic or another suitable material. The cover 46 has an outer surface 120 and a number of interior walls 122, which separate the interior space of the cover into individual areas, each one of which is suited to receive one of the daughter board portion modules 42. The cover 46 has slots 126 for receiving and securing the members 90 of the retaining strips 86 of the daughter board portion modules 42. The slots 126 may have a dove-tail shape which corresponds to the shape of the tab-like members 90. The slots 126 may be tapered, becoming narrower along their length toward the interior spaces of the cover 46. Such a tapered shape facilitates insertion and retention of the daughter board portion modules 42. Holes 130 in the cover 46 are adapted to receive the protrusions 96 of the modules 42.

The cover 46 includes the daughter board portion guide 36, which facilitates proper alignment and mating between the daughter board portion 16 and the mother board portion 18. The daughter board portion guide 36 has a polarized array 132 of raised portions 134 and recessed portions 136 for mating with a corresponding array on the mother board portion guide 38. Such a polarizing feature encourages proper positional alignment of the connector portions 16 and 18 before the connector portions engage. The array may have a non-repeating pattern, such as having a central raised or recessed portion which is wider or narrower than the outer portions. The non-repeating pattern acts as a further guard against attempts to engage the portions 16 and 18 when the portions are mis-aligned.

The daughter board portion guide 36 has a beveled front edge 138. In addition, the raised portions 134 of the polarized array 132 may have beveled side edges. Such beveled edges enable the portions to self-align and engage even if offset by a small amount.

FIGS. 21–24 show the assembled daughter board portion 16. The assembly is accomplished by loading the daughter board portion modules 42 into the cover 46. The daughter board portion guide 37 is then secured to the portion 16 by means of slots in the guide 37 into which the tab-like members 92 are inserted. The slots in the guide 37 may be similar to the slots 126 in the guide 36.

The daughter board portion guide 37 may be made of the same material as the cover 46. The guide:37 has a beveled front edge 140 to facilitate correction of minor misalignments when coupling or engaging the portions 16 and 18 to one another.

It will be appreciated that the daughter board portion 16 may alternatively include a greater or lesser number of daughter board portion modules 42 than as shown.

It will further be appreciated that the daughter board portion 16 may have a special end module on one end. The special end module may have no active signal conductors (having no conductors with signals passing therethrough), but only reference conductors. The use of an special end module avoids the problem of signal conductors on an end module not being fully surrounded by reference conductors. The special end module may have a unique design which includes only reference conductors. Alternatively, the special end module may have the same or a similar design to that of the daughter board portion modules 42, with the signal conductors of the special end module connected to ground or reference, or not electrically connected (not electrically active) at all.

Turning now to FIGS. 25–28, details of the mother board portion module 44 are shown. It will be appreciated that the mother board portion module 44 shares many features with the daughter board portion module 42. The mother board portion module 44 has a reference element 150 which includes reference conductors 152 having reference contact ends 154, reference extensions 156, and reference pins 158. The reference element has a metal strip connecting and electrically coupling all parts of the reference element.

A plurality of signal conductors 160 are located between respective pairs of the reference conductors 152. The reference extensions 156 are located above (as illustrated) the signal conductors 160. More generally, the reference extension 156 corresponding to an individual of the signal conductors 160 may be described as being in a direction relative to the signal conductor which is substantially perpendicular to the directions of the reference conductors 152 relative to the signal conductor.

The signal conductors 160 each have respective signal pin ends 162 and signal contact ends 164. The reference contact ends 154 extend beyond the signal contact ends 164.

The signal conductors 160 and the reference element 150 are secured by a reference strip 170. The reference strip 170 has tab-like members or surfaces 172 and 174 for engaging slots in the mother board portion guides 38 and 39.

FIGS. 29–32 show a number of the mother board portion modules 44 joined together by the mother board portion guides 38 and 39, to thereby form the mother board portion 18.

The mother board portion guide 38 has a polarized array 178 which corresponds to the polarized array 132 of the daughter board portion guide 36. The mother board portion guide 38 also has a beveled front edge 180.

Figure 33:
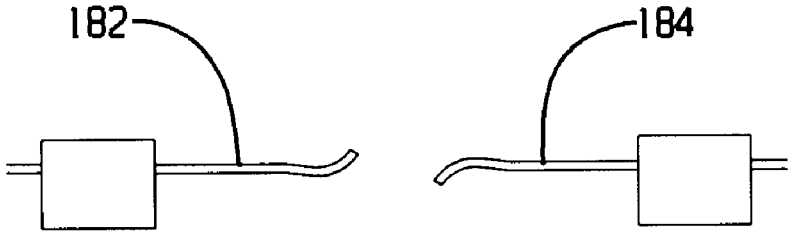
FIGS. 33 and 34 are side views illustrating connection of hermaphrodite contact ends used in the interconnect system of FIG. 1.
Figure 34:
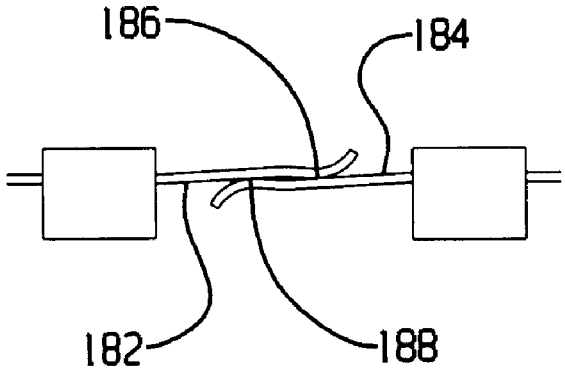

FIGS. 33 and 34 illustrate an exemplary pair of hermaphroditic contact ends 182 and 184 which are made of a resilient material. The contact ends 182 and 184 correspond to a pair of mating contact ends, one from each of the daughter and mother board portions 16 and 18. By "hermaphroditic" it is meant that the shapes of the ends are substantially identical and they mate without gender limitations. Such contacts are described in commonly-assigned U.S. Pat. No. 5,098,311, entitled "Hermaphroditic Interconnect System," which is incorporated herein by reference in its entirety. Hermaphroditic contacts are largely planar, which allows for ease of manufacture and results in very little geometrical discontinuity in the connection; sometimes these contacts are referred to as two dimensional rather than three dimensional. Geometrical discontinuities can cause signal reflections of high-frequency signals, which can result in degradation of electrical signals. The lack of geometrical discontinuity in hermaphroditic contacts minimizes the electrical discontinuity in the connection, which results in a cleaner electrical signal.

Hermaphroditic contacts have the additional advantage of requiring greatly reduced insertion forces when compared to typical male-female contacts. For example, insertion forces for hermaphroditic contacts may be only 30–40% those of typical gendered contacts. When a connector includes a large number of contacts, this reduction in insertion forces may allow a connector with hermaphroditic contacts to be pressed into place with a reasonable force, whereas a connector having the same number of typical gendered contacts may require a jack screw or other mechanism to provide sufficient force for insertion. In addition, the reduced insertion forces make for longer life for the contacts, and a connector that requires reduced insertion forces usually would not have to be designed to endure high forces, thus also reducing the size and amount of material required to make the connector.

As shown in FIG. 34, the contact ends 182 and 184 have two contact points 186 and 188, thus better ensuring an electrical connection between the contacts 182 and 184.

Adjacent of the contact ends in the portions 16 and 18 may alternate tip offset directions so that torsional moments, for example at the guides 36–39, are balanced and no restraining moments on the guides 36–39 are required.

The contact ends may be plated with, for example, gold or palladium nickel, to improve conductance while still providing a durable surface that will resist wear as the portions are joined and disjoined.

Two slightly different designs of hermaphroditic contacts may be employed, such that the contact ends for ground or reference connections of at least one of the connector portions 16 and 18 (or of both connector portions) have a longer stroke than the contact ends for signal connections. Thus as the portions 16 and 18 mate, the ground connections engage before the signal connections. Similarly, when the portions 16 and 18 are disconnected the signal connections disengage before the ground connections. By having the ground connections engage first and disengage last an additional measure of electrical protection is provided for circuits on the boards 12 and 14, for example, allowing for discharge to ground of static electric charge before connecting signal conductors.

Although the contacts ends have been described above in terms of a specific hermaphroditic connection design, it will be appreciated that gendered connectors or other hermaphroditic connectors could be substituted.

It will be appreciated that many of the steps for manufacturing the portions 16 and 18 described above may be performed using reel-to-reel manufacturing processes. A carrier may be employed to link multiple, like components together during manufacturing processes such as stamping or punching, overmolding, and/or plating.

It will be appreciated that the interconnect system 10 described above may be modified to accomplish a variety of electrical connections. FIGS. 35–40 show examples of a variety of connects that may be made with interconnect systems of the present invention.

Figure 35:
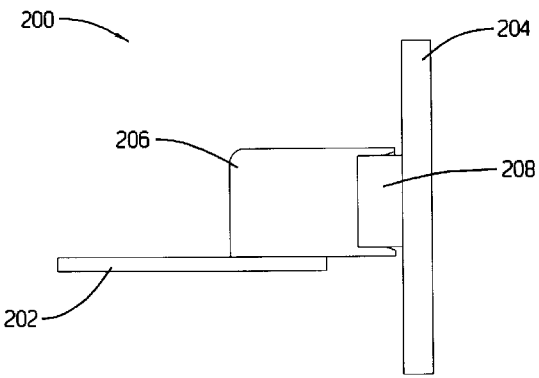

FIG. 35 shows a back plane connection scheme 200 similar to that described in detail above. A daughter board 202 is coupled to a mother board 204 by means of a right angle portion 206, which is coupled to the daughter board and which engages a straight portion 208. The straight portion 208 in turn is coupled to the mother board 204. The right angle portion 204 corresponds to the daughter board portion 16 described above, and the straight portion 208 corresponds to the mother board portion 18 described above.

Figure 36:
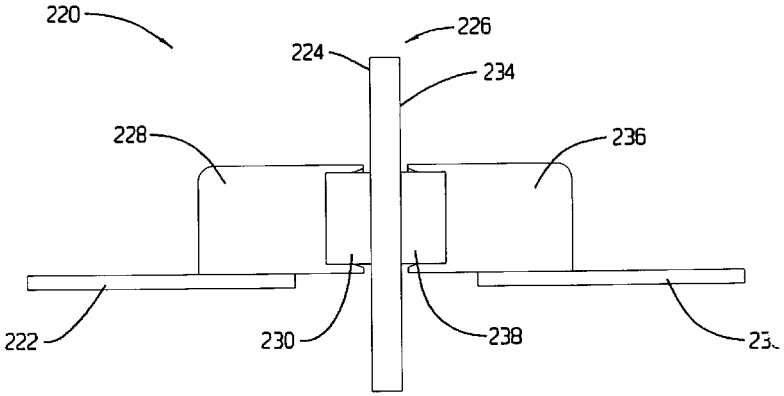
FIGS. 35–40 illustrate various connection schemes using the interconnection system of the present invention.

FIG. 36 illustrates a mid-plane connection scheme 220. A first daughter board 222 is coupled to one side 224 of a mother board 226 by a first right angle portion 228 and a first straight portion 230. A second daughter board 232 is coupled to the other side 234 of the mother board 226 by a second right angle portion 236 and a second straight portion 238.

Figure 37:
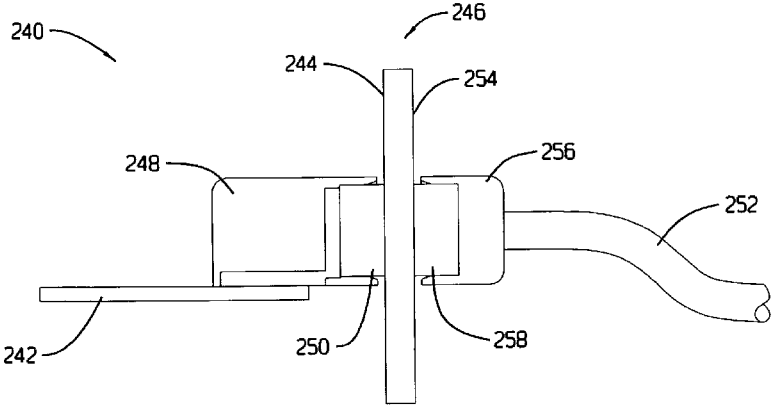

A cable-to-mother-board connection scheme 240 is shown in FIG. 37. A daughter board 242 is coupled to one side 244 of a mother board 246 by a right angle portion 248 and a straight portion 250. A cable 252 is coupled to the other side 254 of the mother board 246 via a cable connector 256 which engages a straight portion 258.

Figure 38:
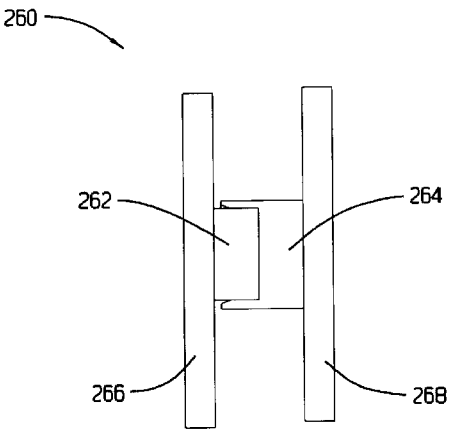

FIG. 38 shows a mezzanine connection scheme 260, wherein a pair of straight portions 262 and 264 are used to connect a pair of substantially-parallel, offset boards 266 and 268. The portions 262 and 264 may be substantially the same.

Figure 39:
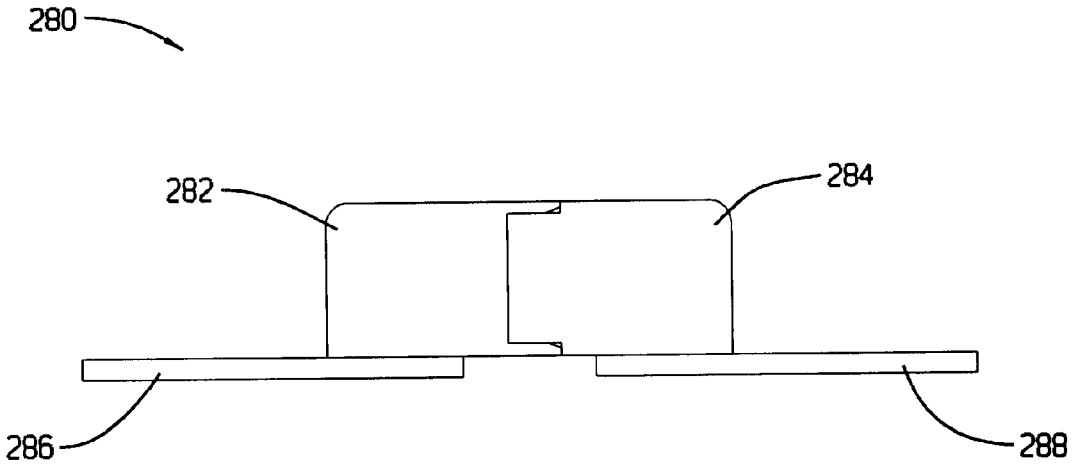

A co-planar connection scheme 280 is illustrated in FIG. 39, wherein a pair of right angle portions 282 and 284 are used to connect side-by-side boards 286 and 288. The portions 282 and 284 may be substantially the same.

Figure 40:
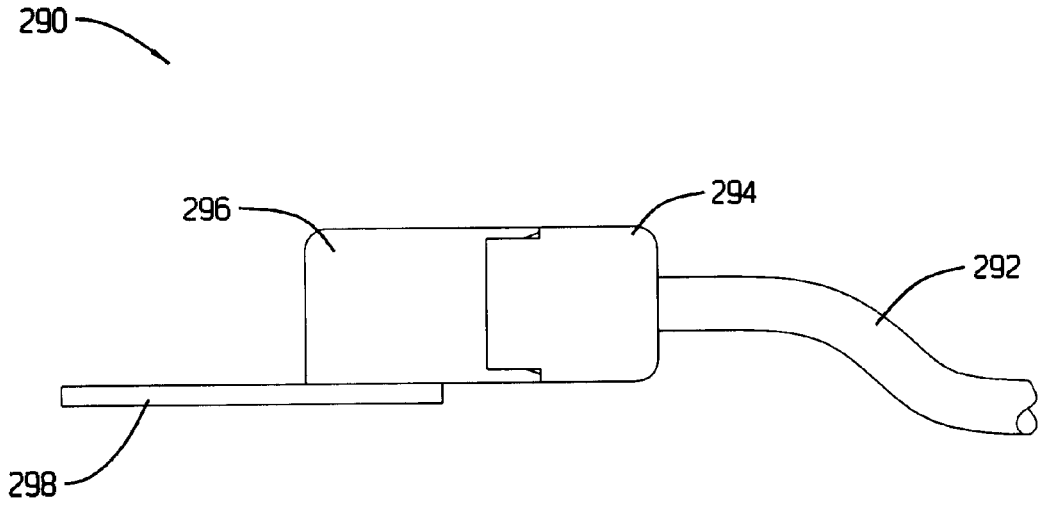

FIG. 40 illustrates a cable to board connection scheme 290. A cable 292 has a cable connector 294 which engages a right-angle portion 296 mounted on a board 298.

It will be appreciated that the connection schemes shown in FIGS. 35–40 are but a few of the many possible connection schemes for interconnect systems utilizing the present invention.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical connector module comprising:

a plurality of signal conductors, the signal conductors being substantially parallel within a first plane;

a reference conductor element made of a single piece of sheet metal, which includes:

a first plurality of reference conductors at least parts of which are in the first plane, wherein the first reference conductors are substantially parallel to one another and are interspersed between the signal conductors; and a second plurality of reference conductors within a second plane which is offset from and substantially parallel to the first plane;

one or more plastic retainer strips securing the signal conductors and the reference conductor element;

wherein the one or more plastic retainer strips are molded onto the signal conductors and the reference conductor element, thereby securely attaching the one or more plastic retainer strips to the signal conductors and the reference conductor element.

2. The module of claim 1, wherein each pair of adjacent signal conductors has one of the first reference conductors therebetween.

3. The module of claim 1, wherein the reference conductors and the signal conductors are configured such that each of the signal conductors has a pair of the first reference conductors adjacent thereto and on opposite sides thereof within the first plane, and has one of the second reference conductors adjacent thereto and spaced apart therefrom in a direction substantially perpendicular to the first plane.

4. The module of claim 3, wherein a space between each of the signals and the pair of the first reference conductors adjacent the signal conductor is substantially free of solid or liquid materials.

5. The module of claim 4, wherein a space between each of the signals and the one of the second reference conductors adjacent thereto is substantially free of solid or liquid materials.

6. The module of claim 3, wherein the reference conductor element includes at least one metal strip in the second plane to which each of the first reference conductors and each of the second reference conductors is attached.

7. The module of claim 6, wherein the second reference conductors each includes a central portion and a bent portion, and the central portion is in the first plane, and the bent portion couples the central portion to the metal strip.

8. The module of claim 1, wherein the parts of the first reference conductors that are not in the first plane, are not in contact with the second reference conductors, with gaps thereby between the second reference conductors and the parts of the first reference conductors.

9. The module of claim 1, wherein the one or more plastic retainer strips include two retainer strips at opposite respective ends of the module.

10. An electrical connector module of comprising:

a plurality of signal conductors, the signal conductors being substantially parallel within a first plane, a reference conductor element made of a single piece of sheet metal, which includes:

a first plurality of reference conductors at least parts of which are in the first plane, wherein the first reference conductors are substantially parallel to one another and are interspersed between the signal conductors; and a second plurality of reference conductors within a second plane which is offset from and substantially parallel to the first plane;

wherein the second reference conductors are wider than the first reference conductors; and wherein the first reference conductors have width in the first plane greater than a thickness of the first reference conductors.

11. An electrical connector element comprising:

1) a plurality of modules, each of the modules including:

a) a plurality of signal conductors, the signal conductors being substantially parallel within a first plane;

b) a reference conductor element made of a single piece of sheet metal, which includes:

i) a first plurality of reference conductors at least parts of which are in the first plane, wherein the first reference conductors are substantially parallel to one another and are interspersed between the signal conductors; and ii) a second plurality of reference conductors within a second plane which is offset from and substantially parallel to the first plane; and c) one or more plastic retainer strips securing the signal conductors and the reference conductor element; and 2) a cover which retains the modules in positional relationship relative to one another;

wherein the one or more plastic retainer strips are molded onto the signal conductors and the reference conductor element, thereby securely attaching the one or more plastic retainer strips to the signal conductors and the reference conductor element.

12. An electrical connector element comprising:

1) a plurality of modules, each of the modules including:

a) a plurality of signal conductors, the signal conductors being substantially parallel within a first plane;

b) a reference conductor element made of a single piece of sheet metal, which includes:

i) a first plurality of reference conductors at least parts of which are in the first plane, wherein the first reference conductors are substantially parallel to one another and are interspersed between the signal conductors; and ii) a second plurality of reference conductors within a second plane which is offset from and substantially parallel to the first plane; and c) one or more plastic retainer strips securing the signal conductors and the reference conductor element; and 2) a cover which retains the modules in positional relationship relative to one another;

wherein the cover has holes therein which are operatively configured to receive a protrusion on one, of the retainer strips of each of the modules.

13. The electrical connector element of claim 11, wherein at least one of the retainer strips of each of the modules has one or more dovetail members, and wherein the cover has slots operatively configured to receive the dovetail members.

14. The electrical connector element of claim 11, wherein each of the reference conductor elements includes at least one metal strip in the second plane to which each of the first reference conductors and each of the second reference conductors of the corresponding module are attached, and wherein the second reference conductors each include a central portion and a bent portion, and the central portion is in the first plane, and the bent portion couples the central portion to the metal strip.

15. The electrical connector element of claim 11, wherein the reference conductors and the signal conductors are configured such that multiple of the signal conductors each have a pair of the first reference conductors adjacent thereto and on opposite sides thereof within the first plane, and each have a pair of the second reference conductors adjacent thereto and spaced apart therefrom, and on opposite sides thereof in a direction substantially perpendicular to the first plane.

16. The electrical connector element of claim 1, wherein the parts of the first reference conductors that are not in the first plane, are not in contact with the second reference conductors, with gaps thereby between the second reference conductors and the parts of the first reference conductors.

17. An electrical connector element comprising:

1) a plurality of modules, each of the modules including:

a) a plurality of signal conductors, the signal conductors being substantially parallel within a first plane;

b) a: reference conductor element made of a single piece of sheet metal, which includes:

i) a first plurality of reference conductors at least parts of which are in the first plane, wherein the first reference conductors are substantially parallel to one another and are interspersed between the signal conductors; and ii) a second plurality of reference conductors within a second plane which is offset from and substantially parallel to the first plane; and c) one or more plastic retainer strips securing the signal conductors and the reference conductor element; and 2) a cover which retains the modules in positional relationship relative to one another, wherein the reference conductors and the signal conductors are configured such that multiple of the signal conductors 1) each have a pair of the first reference is conductors adjacent thereto and on opposite sides thereof within the first plane, and 2) each have a pair of the second reference conductors adjacent thereto and spaced apart therefrom, and on opposite sides thereof in a direction substantially perpendicular to the first plane;

wherein each of the multiple signal conductors 1) is in the same module as the first reference conductors adjacent thereto, 2) is the same module as one of the second reference conductors adjacent thereto, and 3) is in a different module from the other of the second reference conductors adjacent thereto.

18. The electrical connector element of claim 17, wherein a space between each of the multiple signals and the pair of the first reference conductors adjacent thereto is substantially free of solid or liquid materials.

19. The electrical connector element of claim 18, wherein a space between each of the signals and the pair of the second reference conductors adjacent thereto is substantially free of solid or liquid materials.

20. An electrical connector element comprising:

1) a plurality of modules, each of the modules including:

a) a plurality of signal conductors, the signal conductors being substantially parallel within a first plane;

b) a reference conductor element made of a single piece of sheet metal, which includes:

i) a first plurality of reference conductors at least parts of which are in the first plane, wherein the first reference conductors are substantially parallel to one another and are interspersed between the signal conductors; and ii) a second plurality of reference conductors within a second plane which is offset from and substantially parallel to the first plane; and c) one or more plastic retainer strips securing the signal conductors and the reference conductor element; and 2) a cover which retains the modules in positional relationship relative to one another;

wherein the reference conductors and the signal conductors are configured such that multiple of the signal conductors 1) each have a pair of the first reference conductors adjacent thereto and on opposite sides thereof within the first plane, and 2) each have a pair of the second reference conductors adjacent thereto and spaced apart therefrom, and on opposite sides thereof in a direction substantially perpendicular to the first plane;

wherein each of the reference conductor elements includes at least one metal strip in the second plane to which each of the first reference conductors and each of the second reference conductors of the corresponding module are attached, and wherein the second reference conductors each include a central portion and a bent portion, and the central portion is in the first plane, and the bent portion couples the central portion to the metal strip.

21. An electrical connector comprising:

1) a first electrical connector element which includes a plurality of modules and a cover which retains the modules in positional relationship relative to one another, wherein each of the modules includes:

a) a plurality of signal conductors, the signal conductors being substantially parallel within a first plane;

b) a reference conductor element made of a single piece of sheet metal, which includes:

i) a first plurality of reference conductors at least parts of which are in the first plane, wherein the first reference conductors are substantially parallel to one another and are interspersed between the signal conductors; and ii) a second plurality of reference conductors within a second plane which is offset from and substantially parallel to the first plane; and c) one or more plastic retainer strips securing the signal conductors and the reference conductor element; and 2) a second electrical connector element operatively configured to mate with the first electrical connector element, the second electrical connector element including rows of substantially parallel conductors operatively configured to mate with the signal conductors and the first reference conductors.

22. The electrical connector of claim 21, wherein the reference conductors and the signal conductors are configured such that multiple of the signal conductors each have a pair of the first reference conductors adjacent thereto and on opposite sides thereof within the first plane, and has a pair of the second reference conductors adjacent thereto and spaced apart therefrom, and on opposite sides thereof in a direction substantially perpendicular to the first plane, and wherein each of the multiple signal connector 1) is in the same module as the first reference conductors adjacent thereto, 2) is the same module as one of the second reference conductors adjacent thereto, and 3) is in a different module from the other of the second reference conductors adjacent thereto.

23. The electrical connector element of claim 22, wherein a space between each of the multiple signals and the pair of the first reference conductors adjacent thereto is substantially free of solid or liquid materials, and wherein a space between each of the signals and the pair of the second reference conductors adjacent thereto is substantially free of solid or liquid materials.

24. The electrical connector element of claim 22, wherein each of the reference conductor elements includes at least one metal strip in the second plane to which each of the first reference conductors and each of the second reference conductors of the corresponding module are attached, and wherein the second reference conductors each include a central portion and a bent portion, and the central portion is in the first plane, and the bent portion couples the central portion to the metal strip.

25. The electrical connector of claim 24, wherein the at least one metal strip includes first and second metal strips at respective opposite ends of the reference conductor element.

26. An electrical connector element comprising:

1) a plurality of modules, each of the modules including:

a) a plurality of signal conductors, the signal conductors being substantially parallel within a first plane;

b) a reference conductor element made of a single piece of sheet metal, which includes:

i) a first plurality of reference conductors at least parts of which are in the first plane, wherein the first reference conductors are substantially parallel to one another and are interspersed between the signal conductors; and ii) a second plurality of reference conductors within a second plane which is offset from and substantially parallel to the first plane; and c) one or more plastic retainer strips securing the signal conductors and the reference conductor element; and 2) a cover which retains the modules in positional relationship relative to one another;

wherein the cover has a plurality of interior walls separating an interior space of the cover into a plurality of individual areas, and wherein the modules are inserted into respective of the individual areas.

27. The electrical connector of claim 25, wherein the first reference conductors are not in contact with the second reference conductors except at the metal strips.

28. The electrical connector of claim 21, wherein the parts of the first reference conductors that are not in the first plane, are not in contact with the second reference conductors, with gaps thereby between the second reference conductors and the parts of the first reference conductors.

29. A method of making an electrical connector module, comprising:

making a reference conductor sheet having plural reference conductors, several of the reference conductors being in a substantially common plane of the sheet and several other of the reference conductors having portions out of the plane of the sheet, placing the reference conductor sheet relative to a plurality of signal conductors such that the several reference conductors are spaced away from the signal conductors and the several other reference conductors are between the signal conductors; and molding at least one plastic retainer onto the reference conductor sheet and the signal conductors, thereby attaching the at least one plastic retainer to the reference conductor sheet and the signal conductors.

30. The method of claim 29, wherein the signal conductors are in a first plane, and the several reference conductors have the portions in a second plane spaced apart from the first plane.

31. The method of claim 29, wherein the making the reference conductor sheet by includes cutting a sheet of conductor material and pressing the portions of the several other reference conductors out of the plane of the sheet.

32. An electrical connector module comprising:

a plurality of signal conductors, the signal conductors being substantially parallel within a first plane; and a reference conductor element which includes:

a first plurality of reference conductors at least parts of which are in the first plane, wherein the first reference conductors are substantially parallel to one another and are interspersed between the signal conductors; and a second plurality of reference conductors within a second plane which is offset from and substantially parallel to the first plane;

wherein the reference conductor element includes at least one metal strip in the second plane to which each of the first reference conductors and each of the second reference conductors is attached; and wherein the at least one metal strip includes first and second metal strips at respective opposite ends of the reference conductor element.

33. The module of claim 32, wherein the second reference conductors each includes a central portion and a bent portion, and the central portion is in the first plane, and the bent portion couples the central portion to the metal strips.

34. The module of claim 32, wherein the first reference conductors are not in contact with the second reference conductors except at the metal strips.

35. The module of claim 32, further comprising one or more plastic retainer strips securing the signal conductors and the reference conductor element, wherein the one or more plastic retainer strips are molded onto the signal conductors and the reference conductor element, thereby securely attaching the one or more plastic retainer strips to the signal conductors and the reference conductor element.

36. An electrical connector element comprising:

1) a plurality of modules, each of the modules Including:

a) a plurality of signal conductors, the signal conductors being substantially parallel within a first plane;

b) a reference conductor element made of a single piece of sheet metal, which includes:

i) a first plurality of reference conductors at least parts of which are in the first plane, wherein the first reference conductors are substantially parallel to one another and are interspersed between the signal conductors; and ii) a second plurality of reference conductors within a second plane which is offset from and substantially parallel to the first plane; and c) one or more plastic retainer strips securing the signal conductors and the reference conductor element; and 2) a cover which retains the modules in positional relationship relative to one another;

wherein each of the reference conductor elements includes at least one metal strip in the second plane to which each of the first reference conductors and each of the second reference conductors of the corresponding module are attached;

wherein the second reference conductors each include a central portion and a bent portion, and the central portion is in the first plane, and the bent portion couples the central portion to the metal strip; and wherein the at least one metal strip includes first and second metal strips at respective opposite ends of the reference conductor element.

37. The electrical connector element of claim 36, wherein the first reference conductors are not in contact with the second reference conductors except at the metal strips.

* * * * *